US009416588B2

(12) United States Patent
Cheng

(10) Patent No.: US 9,416,588 B2
(45) Date of Patent: Aug. 16, 2016

(54) SAFETY ASSEMBLY STRUCTURE OF CURTAIN BEAD CHAIN

(71) Applicant: CHEN TIAN CO., LTD., Tainan (TW)

(72) Inventor: Ching-Hsiang Cheng, Tainan (TW)

(73) Assignee: Chen Tian Co., Ltd., Tainan (TW)

( * ) Notice: Subject to any disclaimer, the term of this patent is extended or adjusted under 35 U.S.C. 154(b) by 318 days.

(21) Appl. No.: 14/180,645

(22) Filed: Feb. 14, 2014

(65) Prior Publication Data

US 2015/0007421 A1 Jan. 8, 2015

(30) Foreign Application Priority Data

Jul. 4, 2013 (TW) ..... 102212592 U

(51) Int. Cl.
*E06B 9/326* (2006.01)

(52) U.S. Cl.
CPC ..... *E06B 9/326* (2013.01); *E06B 2009/3265* (2013.01); *Y10T 24/3982* (2015.01)

(58) Field of Classification Search
CPC . E06B 9/326; E06B 2009/3265; E06B 9/262; A44C 5/185; F16G 11/00
USPC ..... 160/178.1, 178.2, 340
See application file for complete search history.

(56) References Cited

U.S. PATENT DOCUMENTS

| | | | | | |
|---|---|---|---|---|---|
| 5,634,244 | A * | 6/1997 | Fetsch | A44C 5/185 | 160/178.1 R |
| 8,365,362 | B2 * | 2/2013 | Chou | E06B 9/262 | 160/178.1 R |
| 9,151,109 | B2 * | 10/2015 | Kawai | E06B 9/262 | |
| 2011/0108217 | A1 * | 5/2011 | Levin | F16G 11/00 | 160/340 |
| 2011/0194895 | A1 * | 8/2011 | Lai | E06B 9/326 | 403/361 |

FOREIGN PATENT DOCUMENTS

| | | | |
|---|---|---|---|
| GB | 2428269 | * | 1/2007 |
| JP | 2003-184456 | * | 3/2003 |
| TW | M400279 U1 | | 3/2011 |
| WO | 2011/129345 | * | 10/2011 |

* cited by examiner

*Primary Examiner* — David B Jones
(74) *Attorney, Agent, or Firm* — Rosenberg, Klein & Lee

(57) ABSTRACT

A safety assembly structure of a curtain bead chain is revealed herein. It comprises a bead chain having a string with a plurality of beads and having a safety assembly thereon for controlling a curtain. The safety assembly includes two insert blocks for joining to both ends of the string of the bead chain and a connecting unit wrapping around the two insert blocks for connecting thereof.

11 Claims, 10 Drawing Sheets

SAFETY ASSEMBLY STRUCTURE OF CURTAIN BEAD CHAIN

BACKGROUND OF THE INVENTION

1. Field of the Invention

The present invention relates to a safety assembly structure of a curtain bead chain to prevent children's neck from being wrapped around by the bead chain.

2. Description of Related Art

Generally, retractor structures on existing curtains are equipped with a flexible pulling cord for users to control the curtain, allowing the curtain to vertically or horizontally shrink or extend. The conventional curtain structure is provided with a rotating axis with a curtain wrapped up thereon, and a retractor having a bead chain is disposed on the rotating axis. The retractor and the rotating axis can be driven to control the curtain by pulling the bead chain. However, bead chains are ring-shaped and have a relative high toughness, unsophisticated children who are curious about bead chains and playing them would sometimes have choking accidents due to their necks being wrapped around by bead chains. To avoid the accident, a Taiwan Patent No. M400279, issued on 21 Mar. 2011, has disclosed a safety connecting assembly of a curtain pulling cord, comprising a first connecting block and a second connecting block, wherein the first connecting block includes a main body for fixing on a predetermined end of the curtain pulling cord, the main body has a connecting surface having a convex pillar provided with a convex body thereon, the second connecting block includes a main body for fixing on a predetermined end of the curtain pulling cord, the main body has a connecting surface having an engaging slot for engaging the convex pillar therein, and the engaging slot is provided with a fixing recess on the internal wall for engaging the convex body. Accordingly, if the curtain pulling cord receives a pulling force exceeding a predetermined value, the first connecting block and the second connecting block are allowed to disconnect. However, aforementioned structures have the following disadvantages in production and use thereof:

1. The structure is only suitable for a pulling cord having a large diameter, such as 8 mm.

2. It is difficult to manufacture the pulling cord having a diameter less than 4.5 mm in a mold and even difficult to model the same.

3. Plastic injection molding in a small space may cause a volume change due to cold shrinkage, resulting in an increased defective rate.

4. The second connecting piece having a diameter of 4.5 mm cannot adequately wrap up the string so that the string is prone to detach from the connecting piece and cannot bear too much tension in a case of using large curtains.

SUMMARY OF THE INVENTION

Therefore, in view of the above-mentioned problems, the object of the present invention is to provide a safety assembly structure of a curtain bead chain comprising a safety assembly thereon. It is a safety measures for purpose of preventing children's necks from being wrapped around by the bead chain.

Disclosed herein is a safety assembly structure of a curtain bead chain. It comprises a bead chain having a string with a plurality of beads and having a safety assembly thereon for controlling a curtain, wherein the safety assembly includes two insert blocks for joining to both ends of the string and a connecting unit wrapping around the two insert blocks.

Accordingly, when the bead chain is pulled by an external force, e.g. a force caused by a child's neck wrapped by the bead chain, the two insert blocks are allowed to detach from the safety assembly, which makes the bead chain severed and thus prevent children's neck from being wrapped around.

According to an embodiment of the present invention, the insert block is further provided with a protrusion part having a first end and a second end, wherein the first end of the protrusion part connecting with the insert block has a width less than that of the second end of the protrusion part.

According to an embodiment of the present invention, the connecting unit and the insert block form a separate state under a predetermined range of a pulling force, wherein the predetermined range of the pulling force is above or equal to 3 kg.

DETAILED DESCRIPTION OF THE PREFERRED EMBODIMENT

Hereinafter, an exemplary embodiment of the present invention will be described in detail with reference to the accompanying drawings.

Figure 1:
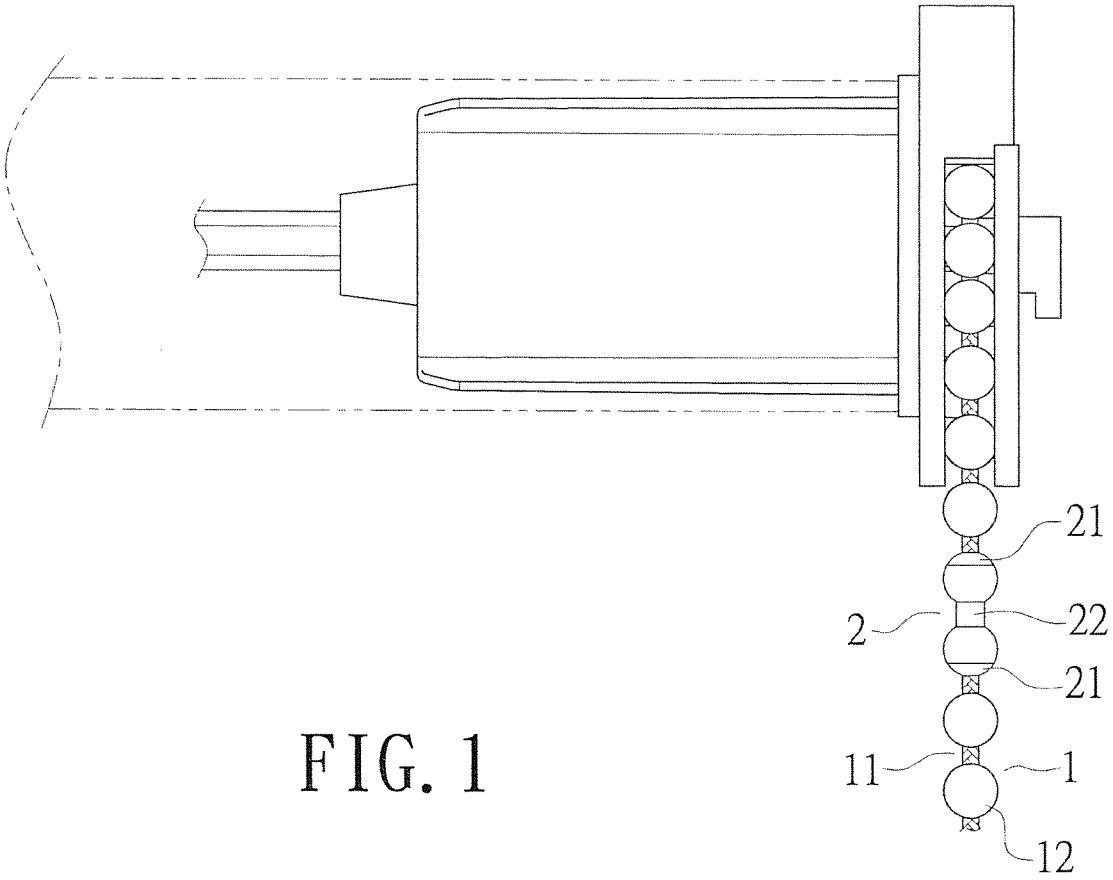
FIG. 1 is a schematic diagram showing a safety assembly structure of a curtain bead chain in the present invention used on a retractor and rotating axis for a curtain shade.
Figure 2:
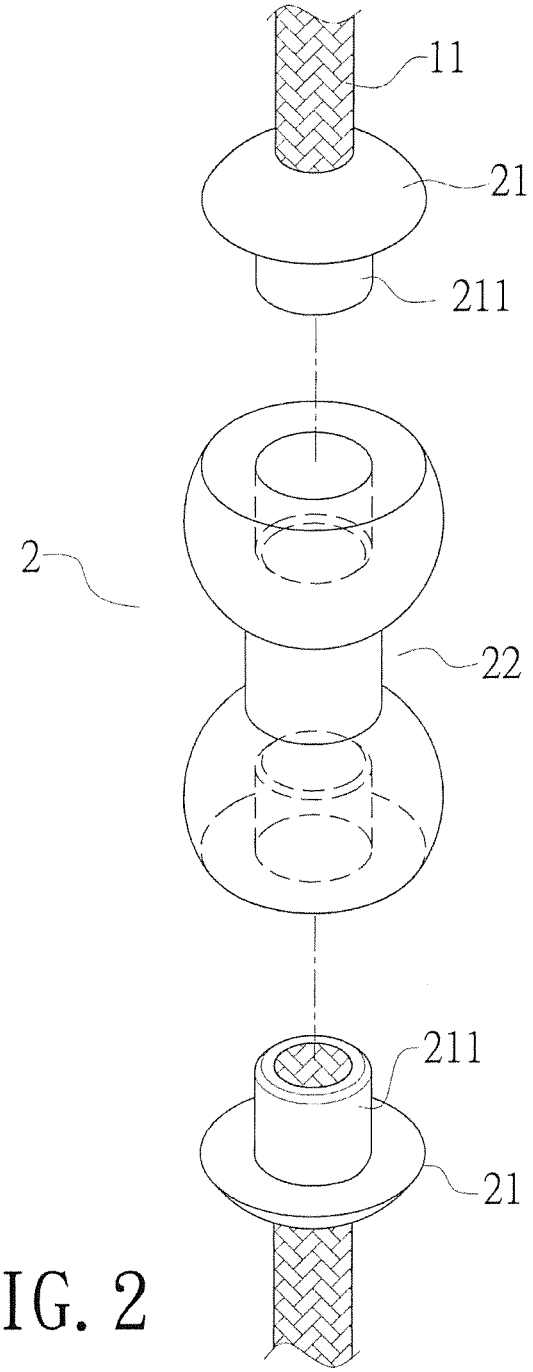
FIG. 2 is a first perspective exploded view showing a safety assembly structure of a curtain bead chain with a cylinder protrusion part according to the present invention.
Figure 3:
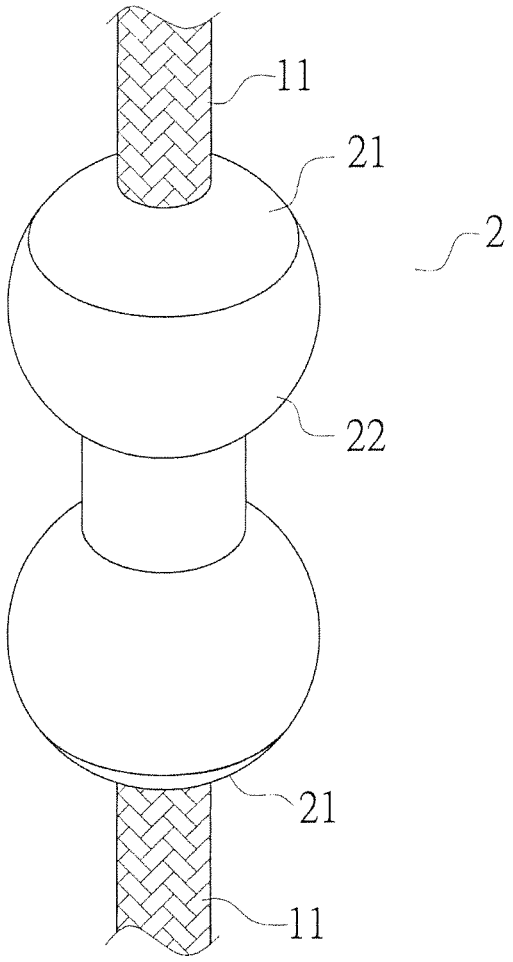
FIG. 3 is a schematic diagram showing a safety assembly structure of a curtain bead chain in an assembled state according to the present invention.
Figure 4:
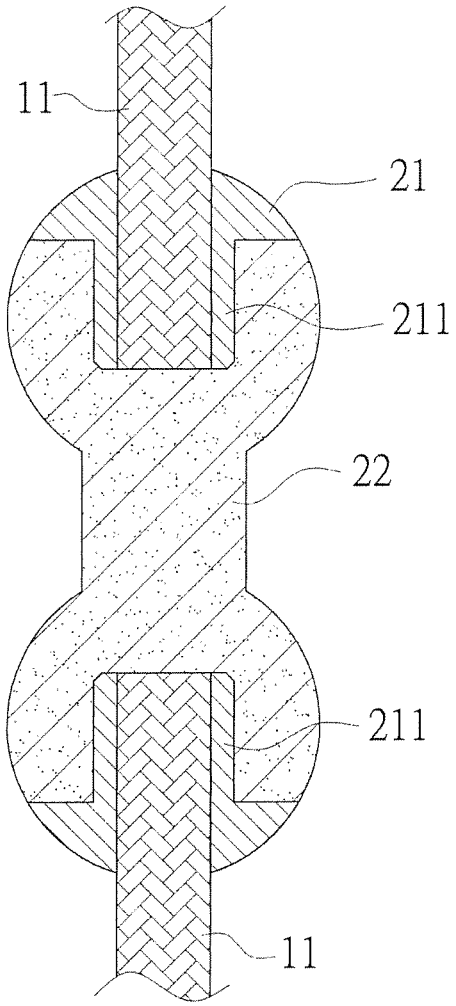
FIG. 4 is a first cross-sectional view showing a safety assembly structure of a curtain bead chain in an assembled state according to the present invention.
Figure 5:
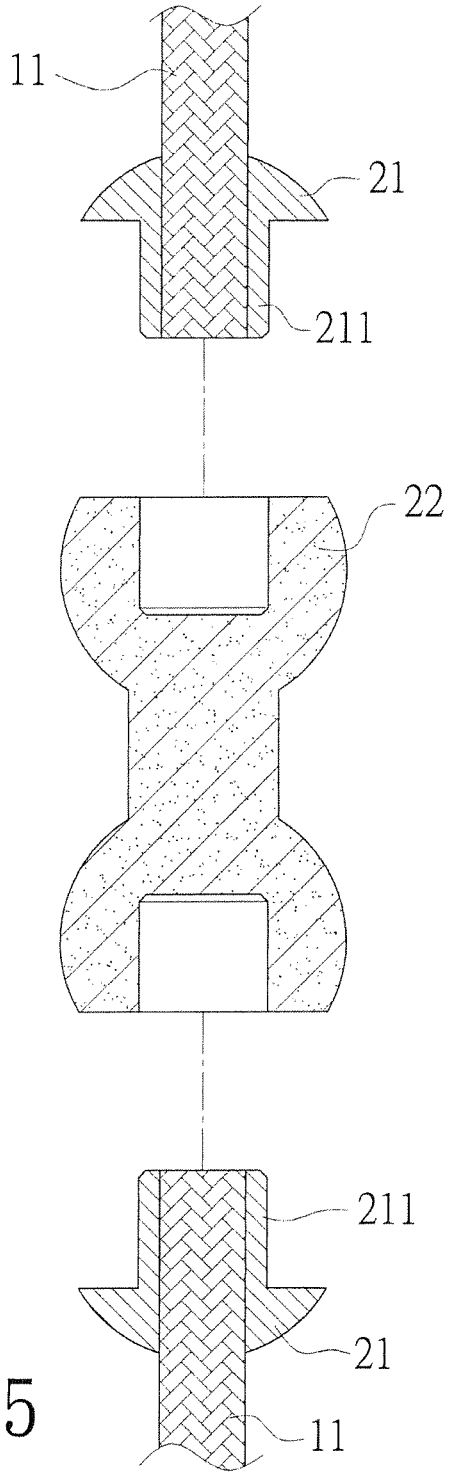
FIG. 5 is a first exploded cross-sectional view showing a safety assembly structure of a curtain bead chain according to the present invention.

First, FIG. 1 to FIG. 3 reveal a schematic diagram showing a safety assembly structure of a curtain bead chain in the present invention used on a retractor and rotating axis for a curtain shade, a first perspective exploded view showing a safety assembly structure of a curtain bead chain with a cylinder protrusion part according to the present invention, and a schematic diagram showing a safety assembly structure of a curtain bead chain in an assembled state according to the present invention. A safety assembly structure of a curtain bead chain comprises:

a bead chain (1) having a string (11) with a plurality of beads (12) thereon; and a safety assembly (2) having two insert blocks (21) and a connecting unit (22) for controlling a curtain, wherein each of the insert blocks (21) has a protrusion part (211) for joining to an end of the string (11) of the bead chain (1) and the connecting unit (22) wraps around the protrusion part (211) for further connection to the two insert blocks (21), and wherein the connecting unit (22) and the insert block (21) form a separate state under a predetermined range of a pulling force.

Moreover, referring to FIG. 1 to FIG. 5, two insert blocks (21) are injection molded and fixed on two ends of the string (11) with the plural beads (12) thereon. Then, the connecting unit (22) is injection molded to wrap around the protrusion part (211) of the insert block (21) after the two insert blocks (21) respectively joining to both ends of the string (11) are placed in a mold. Therefore, the connecting unit (22) connects with the insert blocks (21) to form a bead chain (1).

In use of the bead chain (1), whenever children are accidentally wrapped around by the bead chain (1) and the pulling force is above or equal to a predetermined range, i.e. 3 kg, the connecting unit (22) and the insert blocks (21) will form a separate state.

Figure 6:
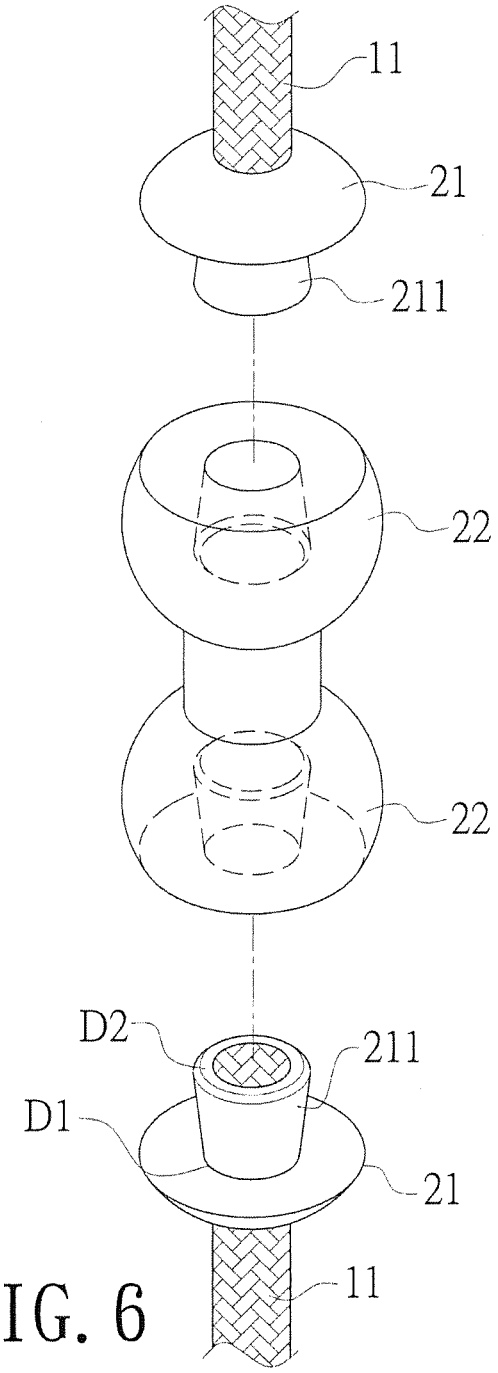
FIG. 6 is a second perspective exploded view showing a protrusion part shaped as circular truncated cone according to an embodiment of the present invention.
Figure 7:
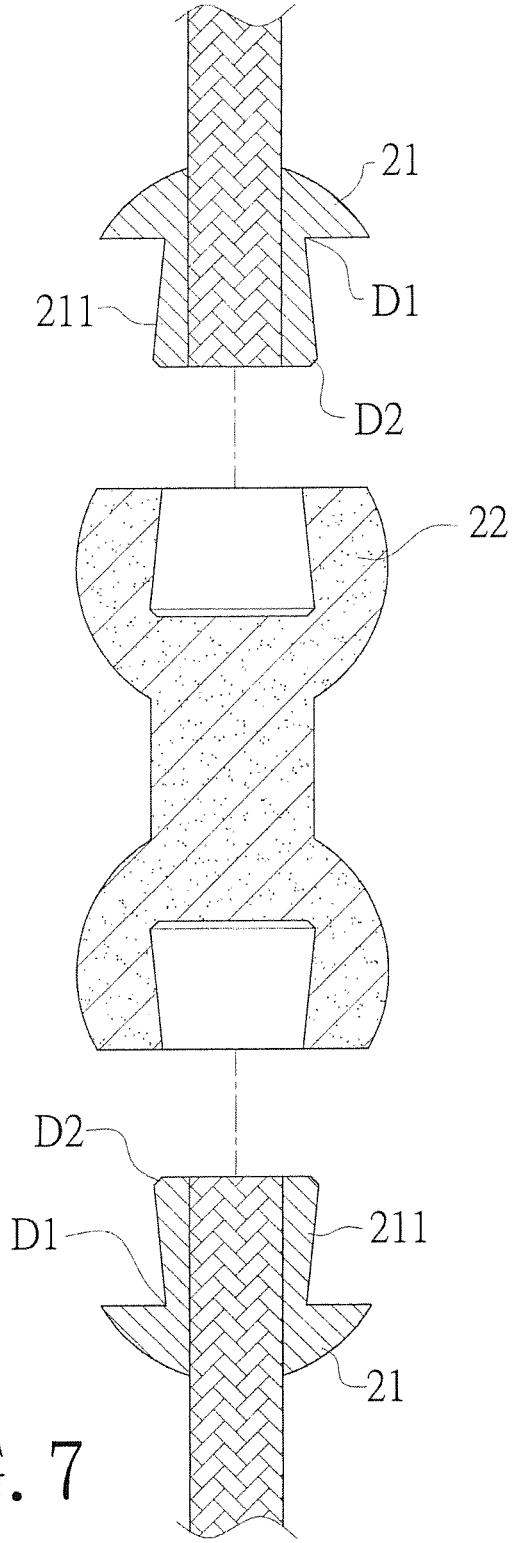
FIG. 7 is a second exploded cross-sectional view showing a protrusion part shaped as circular truncated cone according to an embodiment of the present invention.
Figure 8:
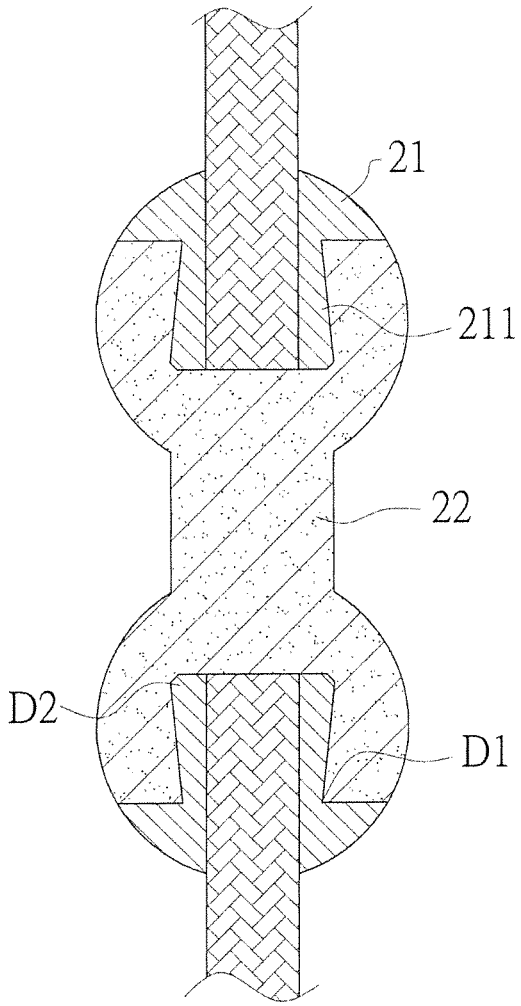
FIG. 8 is a second cross-sectional view showing a safety assembly structure of a curtain bead chain in an assembled state with a protrusion part shaped as a circular truncated cone according to an embodiment of the present invention.
Figure 9:
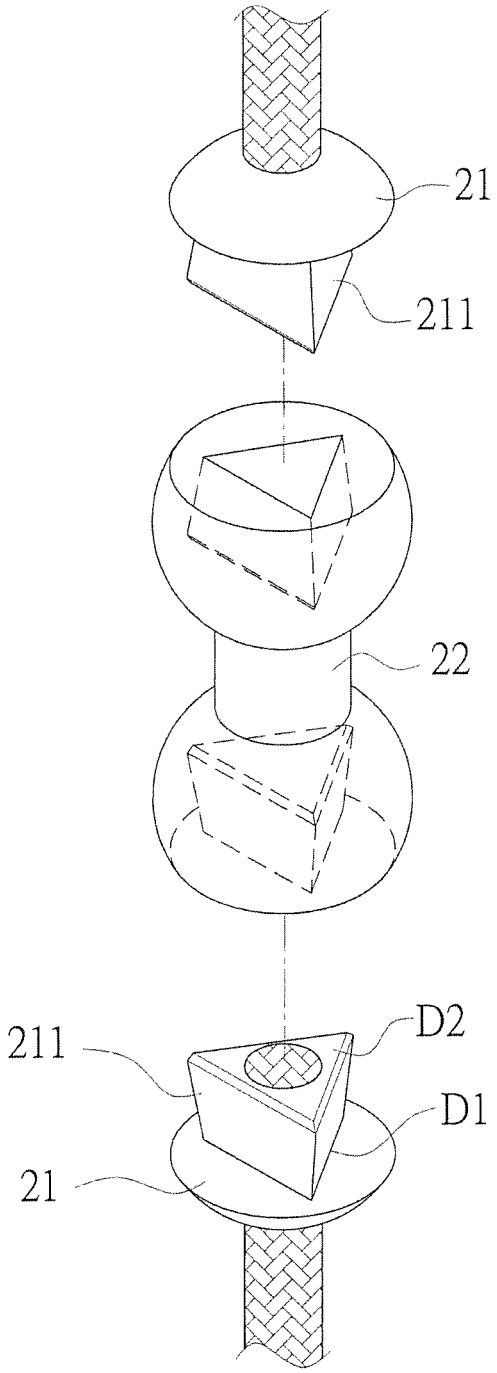
FIG. 9 is a third perspective exploded view showing a protrusion part shaped as a triangular prism according to an embodiment of the present invention.
Figure 10:
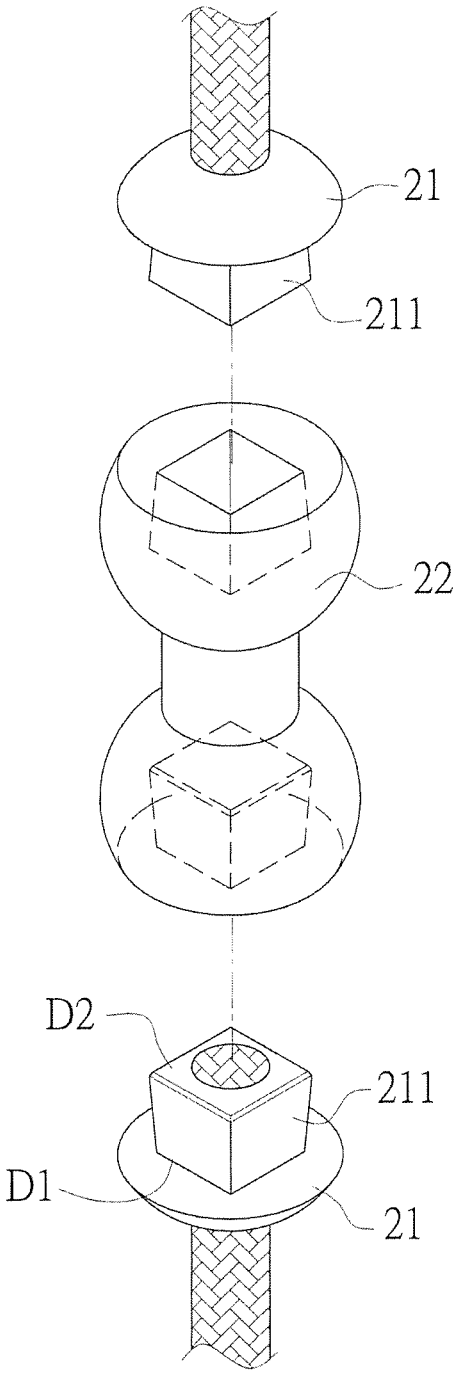
FIG. 10 is a fourth perspective exploded view showing a protrusion part shaped as a square column according to an embodiment of the present invention.

As shown in FIG. 6 to FIG. 8, the separated bead chain (1) can be re-connected again by engaging the protrusion part (211) of the insert block (21) to the connecting unit (22). In the foregoing description, the protrusion part (211) further has a first end (D1) and a second end (D2), and the first end (D1) connecting with the insert block (21) has a width less than that of the second end. Moreover, the protrusion part (211) is shaped as a circular truncated cone or a polygonal column, such as a triangular prism or a square column as shown in FIG. 9 and FIG. 10.

Furthermore, the connecting unit (22) is made of a soft material, e.g. a polyamide (PA) material, and the insert block (21) is made of a relative hard material, e.g. a polyoxymethylene (POM) material.

Accordingly, the insert blocks (21) can join to the string (11) well and respectively secure on two ends of the string (11) firmly.

According to the above description, in comparison with the traditional technique, a safety assembly structure of a curtain bead chain according to the present invention has the advantages as following:

1. Due to the present invention equipped with a safety assembly structure, when the bead chain is pulled by an external force above 3 kg, e.g. a pulling force caused by a child's neck wrapped by the bead chain, the two insert blocks are allowed to detach from the safety assembly, which makes the bead chain severed and thus prevent children's neck from being wrapped around.

2. The safety assembly structure of the present invention is suitable for a pulling cord having a diameter of 4.5 mm, and it can also solve the problem of having a defective rate.

3. Because the insert block is mad of a relative hard material to the connecting unit, the volume change due to cold shrinkage can be avoided, resulting in a decreased defective rate.

4. The insert block is made of a hard POM material for joining to an end of the string, and the connecting unit is made of a flexible PA material and injection molded to wraps around the protrusion part of the insert block. Therefore, the insert block and the connecting unit do not hot melt and can join to each other tightly. After they are separated by a predetermined range of a pulling force, they can be re-connected for use again.

5. The string is embedded in the protrusion part of the insert block, which can strengthen the binding force of the insert block to the string, so that an unexpected destructive breaking of the sting due to a pulling force can be avoided.

What is claimed is:

1. A safety assembly structure of a curtain bead chain, comprises:

a bead chain being formed with a plurality of beads, and a pair of opposing string ends; and a safety assembly for coupling the pair of opposing string ends, the safety assembly having two insert blocks and a connecting unit, wherein each insert block is attached to a corresponding string end and has a protrusion part extending therefrom, the protrusion part having a first end proximal to the insert block and a second distal end, wherein a width of the second end is greater than a width of the first end to define a tapered contour of the protrusion part, and the connecting unit being configured on opposing ends thereof to engage a protrusion part of a corresponding one of the two insert blocks, wherein the protrusion part of at least one of the insert blocks is separated from the corresponding opposing end of the connecting unit responsive to a predetermined pulling force applied to the bead chain.

2. The safety assembly structure of a curtain bead chain as claimed in claim 1, wherein the connecting unit is injection molded to wrap around each protrusion part of each insert block after the two insert blocks respectively joined to the two string ends are placed in a mold.

3. The safety assembly structure of a curtain bead chain as claimed in claim 1, wherein each protrusion part is a circular truncated cone or a polygonal column.

4. The safety assembly structure of a curtain bead chain as claimed in claim 1, wherein each protrusion part is a circular truncated cone or a polygonal column.

5. The safety assembly structure of a curtain bead chain as claimed in claim 1, wherein the predetermined pulling force is greater than or equal to 3 kg.

6. The safety assembly structure of a curtain bead chain as claimed in claim 2, wherein each protrusion part is a circular truncated cone or a polygonal column.

7. The safety assembly structure of a curtain bead chain as claimed in claim 5, wherein the connecting unit is made of a polyamide (PA) material.

8. The safety assembly structure of a curtain bead chain as claimed in claim 5, wherein each protrusion part is a circular truncated cone or a polygonal column.

9. The safety assembly structure of a curtain bead chain as claimed in claim 5, wherein each insert block is made of a polyoxymethylene (POM) material.

10. The safety assembly structure of a curtain bead chain as claimed in claim 7, wherein each protrusion part is a circular truncated cone or a polygonal column.

11. The safety assembly structure of a curtain bead chain as claimed in claim 9, wherein each protrusion part is a circular truncated cone or a polygonal column.

* * * * *